US005859380A

United States Patent [19]

Anada

[11] Patent Number: 5,859,380

[45] Date of Patent: Jan. 12, 1999

[54] KARAOKE APPARATUS WITH ALTERNATIVE RHYTHM PATTERN DESIGNATIONS

[75] Inventor: Keizyu Anada, Hamamatsu, Japan

[73] Assignee: Yamaha Corporation

[21] Appl. No.: 856,300

[22] Filed: May 14, 1997

[30] Foreign Application Priority Data

May 29, 1996 [JP] Japan ..... 8-134501

[51] Int. Cl.[6] ..... G10H 1/40; G10H 7/00

[52] U.S. Cl. ..... 84/611; 84/635

[58] Field of Search ..... 84/609, 611, 613, 84/634, 635, 637

[56] References Cited

U.S. PATENT DOCUMENTS

| | | | |
|---|---|---|---|
| 5,085,118 | 2/1992 | Sekizuka | 84/637 X |
| 5,518,408 | 5/1996 | Kawashima et al. | 84/609 X |
| 5,521,327 | 5/1996 | Kay et al. | 84/611 X |
| 5,668,337 | 9/1997 | Kondo et al. | 84/609 |
| 5,670,731 | 9/1997 | Imaizumi | 84/613 |

FOREIGN PATENT DOCUMENTS

| | | |
|---|---|---|
| 3290696 | 12/1991 | Japan . |
| 702969 | 4/1995 | Japan . |

*Primary Examiner*—David S. Martin
*Assistant Examiner*—Jeffrey W. Donels
*Attorney, Agent, or Firm*—Pillsbury Madison & Sutro

[57] ABSTRACT

A karaoke music piece is selected through a music-piece selecting section 2, and a rhythm for the performance of the karaoke music piece is designated through a rhythm designating section 5. A performance section 6 reads a melody system track of the selected karaoke music piece, and supplies the performance data to a tone generator 8. On the other hand, a rhythm pattern producing section 7 produces a rhythm performance data for the designated rhythm based on a chord and a beat at that time, and supplies the produced data to the tone generator 8. Accordingly, the selected karaoke music piece can be played with the designated rhythm which is different from the original one.

4 Claims, 10 Drawing Sheets

KARAOKE APPARATUS WITH ALTERNATIVE RHYTHM PATTERN DESIGNATIONS

BACKGROUND OF THE INVENTION

1. Field of the Invention

The invention relates to a karaoke apparatus which can play an existing karaoke music piece in such a manner that a performance formation such as a rhythm of the karaoke music piece can be changed in accordance with a preference of the user.

2. Related Art

A music-piece data for karaoke performance which is supplied to a karaoke apparatus is configured by a number of performance data tracks in order to generate various kinds of accompanying tones such as chords and rhythms. The karaoke apparatus reads the music-piece data and then transmits the data to a tone generator, so that a karaoke performance can be executed. So far as the karaoke apparatus executes a karaoke performance based on the same music-piece data, the karaoke performance of the same formation is given.

If the user of a karaoke apparatus always sings a song with the same performance, the user may be bored. Consequently, the user may sometimes wish the same music piece to be performed in a different performance formation. As described above, however, a karaoke apparatus of the prior art has a disadvantage that, so far as a karaoke performance is executed based on the same music-piece data, the karaoke performance of the same formation is given. Moreover, the preparation of music-piece data of a plurality of formations for one karaoke music piece requires much expense in time and effort, and greatly increases the amount of the music-piece data to be stored into the karaoke apparatus. Thus, such preparation is not practial.

SUMMARY OF THE INVENTION

It is an object of the invention to provide a karaoke apparatus which can perform a karaoke music piece in a different formation from an original one by replacing a portion of an existing music-piece data of the karaoke music piece with another one.

According to an embodiment of the present invention, there is provided a karaoke apparatus which reads a karaoke music-piece data including a performance data of a plurality of parts, and which supplies the karaoke music-piece data to a tone generator, thereby generating musical tones of the plurality of parts, wherein the karaoke apparatus comprises: performance data producing means for producing performance data of a portion of the parts based on the read music-piece data; and means for supplying the performance data of the portion of the parts produced by the performance data producing means to the tone generator, instead of performance data of a the corresponding portion of parts in the read karaoke music-piece data.

Accordingly to another embodiment of the present invention, there is provided a karaoke apparatus which reads karaoke music-piece data including: scale system performance data for causing a tone generator to generate musical tones of predetermined tone pitches; and nonscale system performance data for causing the tone generator to generate musical tones of a rhythm accompaniment system, and supplies the karaoke music-piece data to the tone generator, thereby generating scale system musical tones and the nonscale system musical tones, wherein the karaoke apparatus comprises: rhythm designating means for designating a rhythm; performance data producing means for producing nonscale system performance data of the rhythm designated by the rhythm designating means, based on the scale system performance data; and means for supplying the nonscale system performance data produced by the performance data producing means to the tone generator, instead of the scale system performance data of the read karaoke music-piece data.

DETAILED DESCRIPTION OF THE EMBODIMENTS

Figure 1:
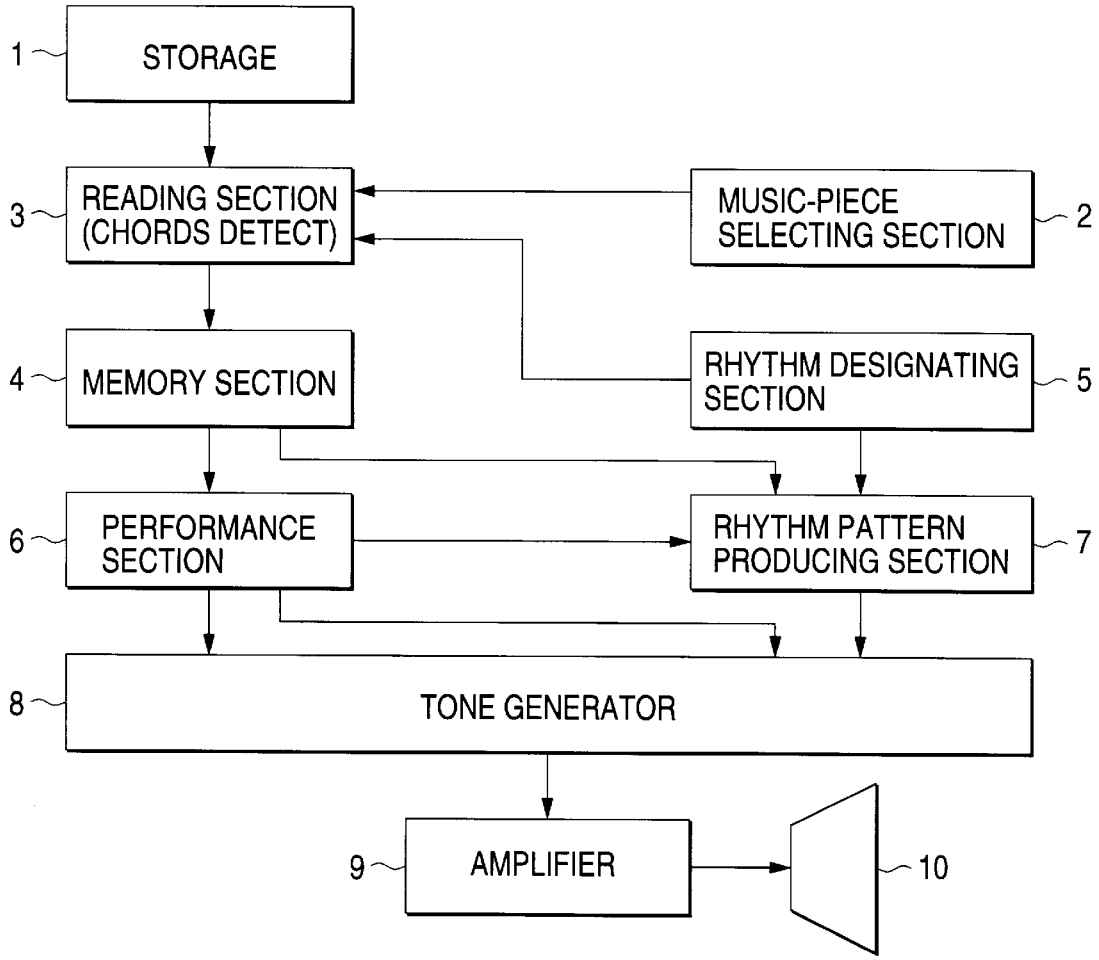
FIG. 1 is a blockdiagram showing the configuration of the present invention.

FIG. 1 is a diagram showing the functional configuration of a karaoke apparatus to which the invention is applied. A storage 1 is configured by a hard disk and the like and stores music-piece data for karaoke performances of about ten thousand music pieces.

Figure 2:
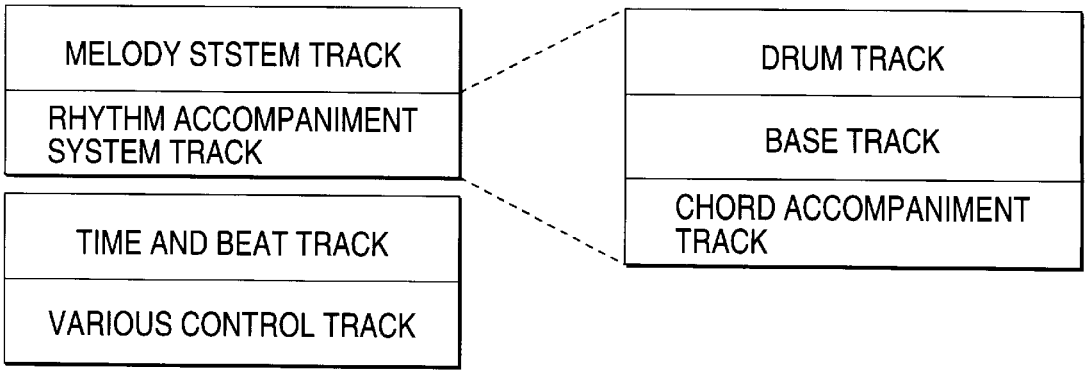
FIG. 2 is a diagram showing the configuration of a karaoke performance data used in the present invention.

A music-piece data has the configuration such as shown in FIG. 2. The music-piece data comprises a melody system track (parts of scale system performance data) and rhythm accompaniment system tracks (parts of nonscale system performance data). The melody system track consists of performance data for causing a tone generator 8 which will be described later, to generate musical tones with scales of a melody line. The rhythm accompaniment system tracks are used for causing the tone generator 8 to generate rhythm tones such as a percussion, a bass, a broken chord, etc. The rhythm accompaniment system tracks include a drum track for generating a musical tone of percussion such as a drum tone, a bass tone track for generating a bass tone, and a chord accompaniment track for generating a chord accompaniment such as a broken chord. The music-piece data comprises, in addition to the melody system track and the rhythm accompaniment system track, various control tracks for controlling a display of words, effects, and the like, and a time and beat track for designating a time and a beat (a beat timing). In embodiments the invention, the scale system performance data is not limited to the melody track, and may be a track of an accompaniment part, as far as a chord can be detected from the track.

In FIG. 1, a music-piece selecting section 2 for selecting one music-piece data from the music-piece data of about ten thousand music pieces stored in the storage 1 is configured by a commander which is an infrared-ray remote controller, and the like. Each music-piece data is identified by using an identification code such as a music-piece number. A music piece can be designated (preselected) by inputting the identification code through the music-piece selecting section 2. When a music piece is preselected, a reading section 3 reads a corresponding music-piece data from the storage 1 and sends the data to a memory section 4. The memory section 4 is configured by a RAM and the like which are incorporated in the apparatus. During the karaoke performance, a performance section 6 which will be described later can rapidly read data from the memory section.

On the other hand, a rhythm can be designated through a rhythm designating section 5. Rhythms which can be designated include rock, bossanova, samba, and the like. When a rhythm is designated through the rhythm designating section 5, the reading section 3 functions also as a chord detecting section. Specifically, when music-piece data is read, the reading section 3 detects a chord from the performance data recorded in the melody system track of the music-piece data. When music-piece data is read from the storage 1, it can be judged which track (MIDI channel) is a melody system track and which track is a rhythm accompaniment system track, based on an attribute message written at the head of the track or a MIDI channel number of the track. Specifically, the contents of the attribute message indicate either of a normal attribute and a rhythm accompaniment attribute. If the attribute message indicates the normal attribute, the track is a melody system track. If the attribute message indicates the rhythm accompaniment attribute, the track is a rhythm accompaniment system track. In the embodiment, it is assumed that the rhythm accompaniment attribute includes a drum attribute, a bass attribute, and a chord accompaniment attribute. If there is no attribute message at the head of the track, it is judged whether the MIDI channel is the 10th channel or not. If the MIDI channel is the 10th channel, the attribute is a rhythm accompaniment attribute (a drum attribute). If the MIDI channel is not the 10th channel, the attribute is a melody attribute. This is specified in the MIDI standard.

On the basis of the performance data in the melody system track which is judged as described above, the reading section (chord detecting section) 3 detects a chord under the following rules.

(1) When three or more tones are simultaneously generated in the same track (i.e., in the same part), it is judged that these tones constitute a chord.

(2) When a tone is long or continues for one or more beats, the tone constitutes a chord.

The detection of a chord is conducted in the unit of one beat. The beat timing may be detected based on data in the time and beat track of the music-piece data. The detected chord is stored into the memory section 4 as a chord track. In the case where a chord cannot be detected in a beat, the chord which was detected in the previous beat is used again.

When the music-piece data is read into the memory section 4 (in the case where a rhythm is designated, when a chord is concurrently stored), it is judged that the preparation of the performance is ready, and the karaoke performance is started. The performance section 6 reads the music-piece data from the memory section 4 in accordance with the tempo of the performance, and supplies event data (performance data) to the tone generator 8, thereby generating musical tones. In the case where a rhythm is not designated through the rhythm designating section 5, the performance section 6 reads all of the tracks (the melody system track, and the rhythm accompaniment system tracks), and supplies the event data to the tone generator 8. In the case where the rhythm is designated by the rhythm designating section 5, only the melody system track is read, and the event data is supplied to the tone generator 8. In this case, beat information is supplied to a rhythm pattern producing section 7. The supply of the beat information is conducted by, for example, an interrupting operation at every beat timing. The rhythm pattern producing section 7 can produce rhythm patterns of various rhythms such as those described above, i.e., rock, bossanova, and samba. The rhythm pattern producing section 7 reads the kind of rhythm which is designated by the rhythm designating section 5, and shifts the pitch of the rhythm pattern based on the chord data supplied from the memory section 4. The operation is implemented at a timing in accordance with the beat data supplied from the performance section 6, so that rhythm accompaniment system performance data is produced. The thus produced rhythm accompaniment system performance data is supplied to the tone generator 8. The tone generator 8 generates a rhythm musical-tone signal based on the performance data. An amplifier 9 is connected to the tone generator 8 and amplifies the musical-tone signal. The amplified musical-tone signal is supplied to a loudspeaker 10.

As described above, in the case where the user designates a rhythm by using the rhythm designating section 5, musical tones of the rhythm accompaniment system of the rhythm designated by the user are performed, instead of the original musical tones of the rhythm accompaniment system in the selected karaoke music piece. Therefore, it is possible to realize a performance in accordance with the user's preferences, and a variation performance in which variations are applied to the original.

Figure 3:
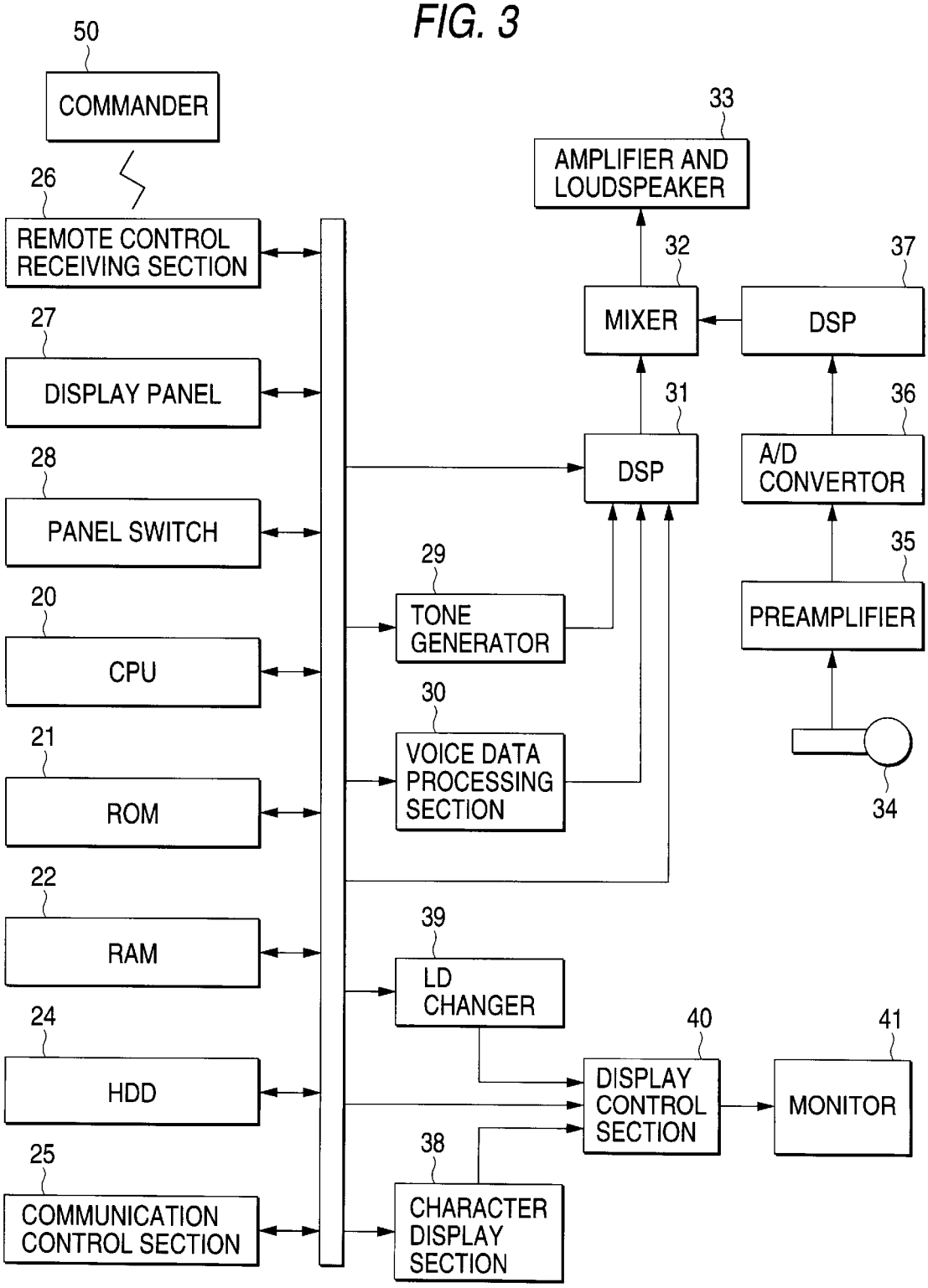
FIG. 3 is a block diagram of a karaoke apparatus which is an embodiment of the present invention.

FIG. 3 is a block diagram of a karaoke apparatus having the above-mentioned rhythm designating function. A CPU 20 which controls the operation of the whole apparatus is connected via a bus to a ROM 21, a RAM 22, a hard disk storage device (HDD) 24, a communication control section 25, a remote control receiving section 26, a display panel 27, a panel switch 28, a tone generator 29, a voice data processing section 30, a DSP 31, a mixer 32, a character display section 38, an LD changer 39, and a display control section 40. A DSP 37 is connected to the mixer 32. The DSP 37 applies effects such as an echo to a sing voice signal which is supplied from a vocal microphone 34. The vocal microphone 34 is connected to the DSP 37 via a preamplifier 35 and an A/D converter 36. The mixer 32 synthesizes the karaoke performance signal supplied from the DSP 31 with the sing voice signal supplied from the DSP 37 at an appropriate ratio, and then outputs the synthesized signal to an amplifier and loudspeaker 33. A monitor 41 is connected to the display control section 40. Among the above-mentioned operating sections, the amplifier and loudspeaker 33, the vocal microphone 34, the LD changer 39, and the monitor 41 are disposed separately from the karaoke apparatus.

Figure 4:
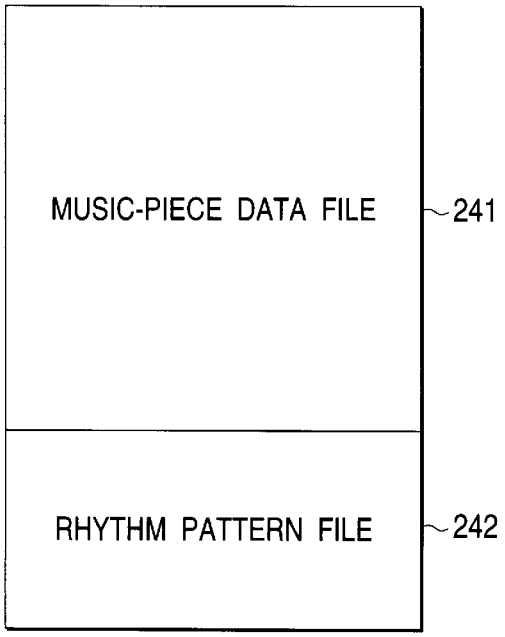
FIGS. 4A and 4B are a diagram showing the configuration of storing areas in a hard disk device and a RAM used in the karaoke apparatus.
Figure 4:
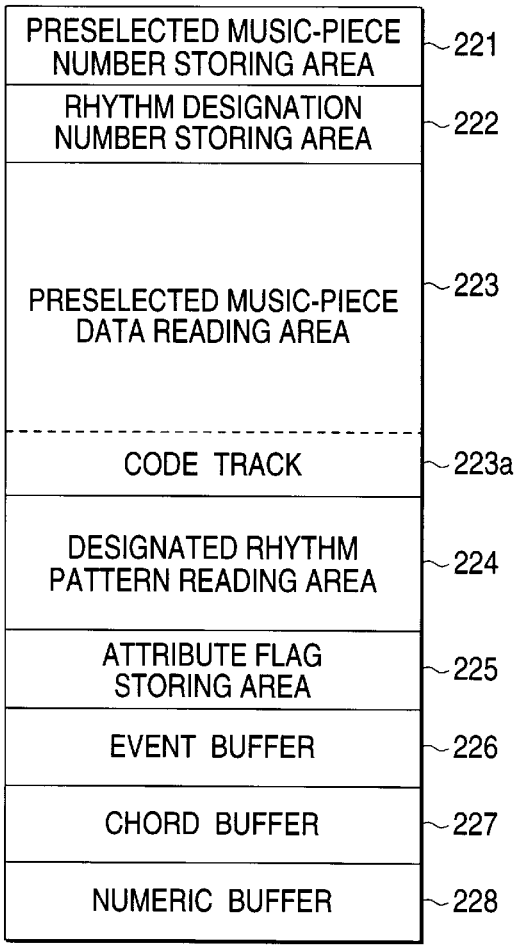

The ROM 21 stores system programs, application programs, a loader, font data, and the like. The system programs are programs for controlling the fundamental operation of the apparatus and the data transmission between the apparatus and peripheral equipment. The application programs include programs for controlling a peripheral equipment and a sequence program. The sequence program is executed during a karaoke performance. In accordance with the sequence program, a music-piece data read into a preselected music-piece data reading area 223 (see FIG. 4(B)) of the RAM 22 is read based on a clock signal, and the music-piece data is sequentially output to the tone generator 29 and the character display section 38, thereby generating a musical-tone signal and displaying words. The loader is a program for downloading music-piece data for karaoke performances and the like from a communication center via the communication control section 25. The loader operates together with other programs in a multitasking manner, and the program which is once written into the RAM 22 is DMA-transferred in units of several hundreds of bytes, so that the program is written into the HDD 24. As shown in FIG. 4(A), the HDD 24 is provided with a music-piece data file 241 for accumulatively storing downloaded music-piece data of about ten thousand music pieces, and a rhythm pattern file 242 for storing a plurality of kinds of rhythm patterns. The rhythm patterns include a pattern of a percussion such as a drum, a pattern of a bass tone, and a pattern of a chord accompaniment such as broken chords. The music-piece data stored in the music-piece data file 241 are identified by music-piece numbers, and the rhythm patterns stored in the rhythm pattern file 242 are designated by rhythm numbers.

FIG. 4(B) shows the configuration of a portion of the RAM 22. In the RAM 22, a preselected music-piece number storing area 221, a rhythm designation number storing area 222, the preselected music-piece data reading area 223, a designated rhythm pattern reading area 224, an attribute flag storing area 225, an event buffer 226, a chord buffer 227, a numeric buffer 228, and the like are set. The preselected music-piece number storing area 221 stores a music-piece number which is preselected and input from a commander 50 which will be described later or the like, and includes music-piece number storing areas for a plurality of music pieces. The rhythm designation number storing area 222 is disposed so as to correspond to the preselected music-piece number storing area, and stores the designated rhythm numbers for the preselected karaoke music pieces. The preselected music-piece data reading area 223 is an area to which a music-piece data of a karaoke music piece which is currently played among the preselected karaoke music pieces is read from the HDD 24. In the preselected music-piece data reading area 223, a chord track 223*a* for storing a chord which is detected during the reading is disposed. The designated rhythm pattern reading area 224 is an area to which a designated rhythm pattern of the karaoke music piece which is currently played is read. The attribute flag storing area stores an attribute of each track of the music-piece data read to the preselected music-piece data reading area 223. The event buffer 226 and the chord buffer 227 are buffers for respectively storing a current event and chord during the karaoke performance. The numeric buffer 228 is an area for buffering a numeric value which is input by using numeric keys of the commander 50.

Figure 5:
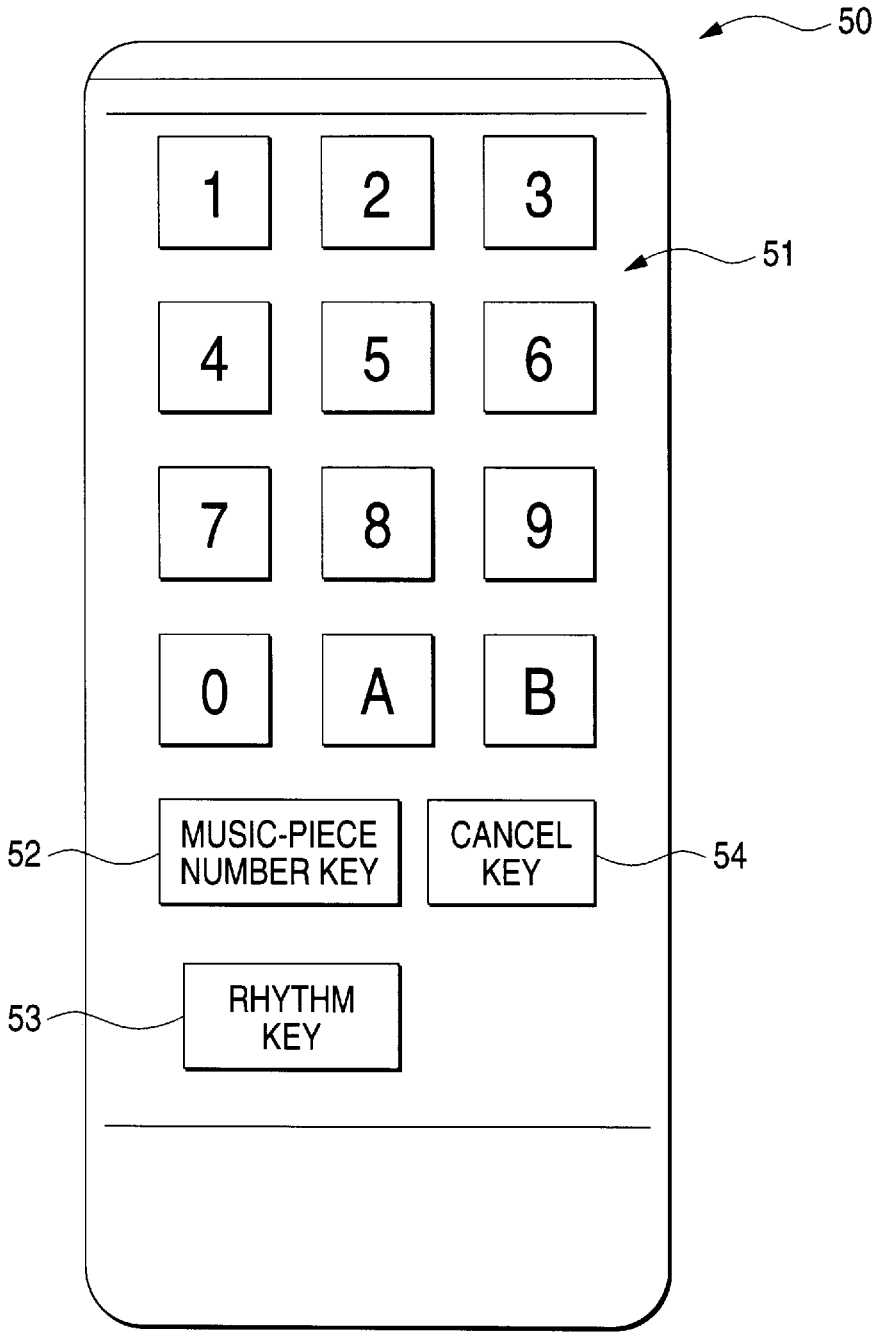
FIG. 5 is a view showing an external appearance of a commander of the karaoke apparatus and a block diagram of the commander.

The remote control receiving section 26 receives an infrared ray signal transmitted from the commander 50 and restores the data. FIG. 5 shows the configuration of the commander 50. The numeric keys 51, a music-piece number key 52, a rhythm key 53, and a cancel key 54 are disposed on the upper face of the commander 50. The numeric keys 51 are key switches for inputting a music-piece number and a rhythm number. The music-piece number key 52 is depressed when a numeric value input by using the numeric keys is to be registered as a preselected music-piece number. The rhythm key 53 is depressed when a numeric value input by using the numeric keys is to be registered as a rhythm number. When either of these key switches is operated by the user, an infrared ray signal which is modulated by a code in accordance with the operation is transmitted.

Referring again to FIG. 3, the display panel 27 comprises an LED display device for displaying the input music-piece number and the like. The panel switch 28 includes, in addition to the numeric keys, key switches which are the same kinds as those of the commander 50. A music-piece number may be input also by operating the panel switch. The tone generator 29 forms a musical-tone signal based on the data supplied from the CPU 20. The tone generator 29 has a plurality of tone generating channels. The tone generating channels can independently form musical-tone signals of different tone colors in response to designation of a tone color. The voice data processing section 30 is a functional section which reproduces a voice signal such as a back chorus. The voice data is obtained by processing a live voice signal so as to convert a signal waveform (such as a back chorus) which is difficult to be electronically generated by the tone generator 29, into an ADPCM data. The voice data is included in a musical-tone data. The DSP 31 applies various effects to the musical-tone signal input from the tone generator 29 and also to the voice signal expanded by the voice data processing section 30. The karaoke performance tones to which the effects are applied are supplied to the mixer 32. On the other hand, the sing voice signal input through the vocal microphone 34 is amplified by the preamplifier 35, and converted into a digital signal in the A/D converter 36. Thereafter, the digital sing voice signal is input into the DSP 37. The DSP 37 applies effects such as an echo to the sing voice signal, and then outputs the signal to the mixer 32. The mixer 32 mixes the karaoke performance tone and the sing voice signal respectively supplied from the DSP 31 and the DSP 37 with each other at an appropriate ratio, and converts the mixed signal into an analog signal. The analog signal is supplied to the amplifier and loudspeaker 33. The amplifier and loudspeaker 33 amplifies the analog signal and outputs the amplified signal as a sound through the loudspeaker. The kinds and degrees of the effects applied by the DSPs 31 and 37 are controlled by a DSP control data supplied from the CPU 20. The DSP control data are included in various control tracks of the music-piece data.

A character display data for displaying a title and words of a karaoke music piece is supplied to the character display section 38. The character display data is a data which is written in a character display track of the music-piece data, and is implemented together with a time interval data (a delta time data) so that the title and the words are displayed and the display color is changed in synchronization with the karaoke performance based on the musical-tone track. The character display section 38 produces character patterns such as the title and the words on the basis of the character display data. The LD changer 39 reproduces a video stored on a laser disc during the karaoke performance. The CPU 20 determines which background video is to be reproduced based on a genre data and the like of a karaoke music piece to be played, and transmits a chapter number of the background video to the LD changer 39. The LD changer 39 selects the video of the chapter designated by the CPU 20 from a plurality of (about five) laser discs, and reproduces the video. The character pattern produced by the character display section 38, and the background video reproduced by the LD changer 39 are supplied to the display control section 40. The display control section 40 superimposes the character pattern on the background video, and displays the synthesized image on the monitor 41.

Figure 6:
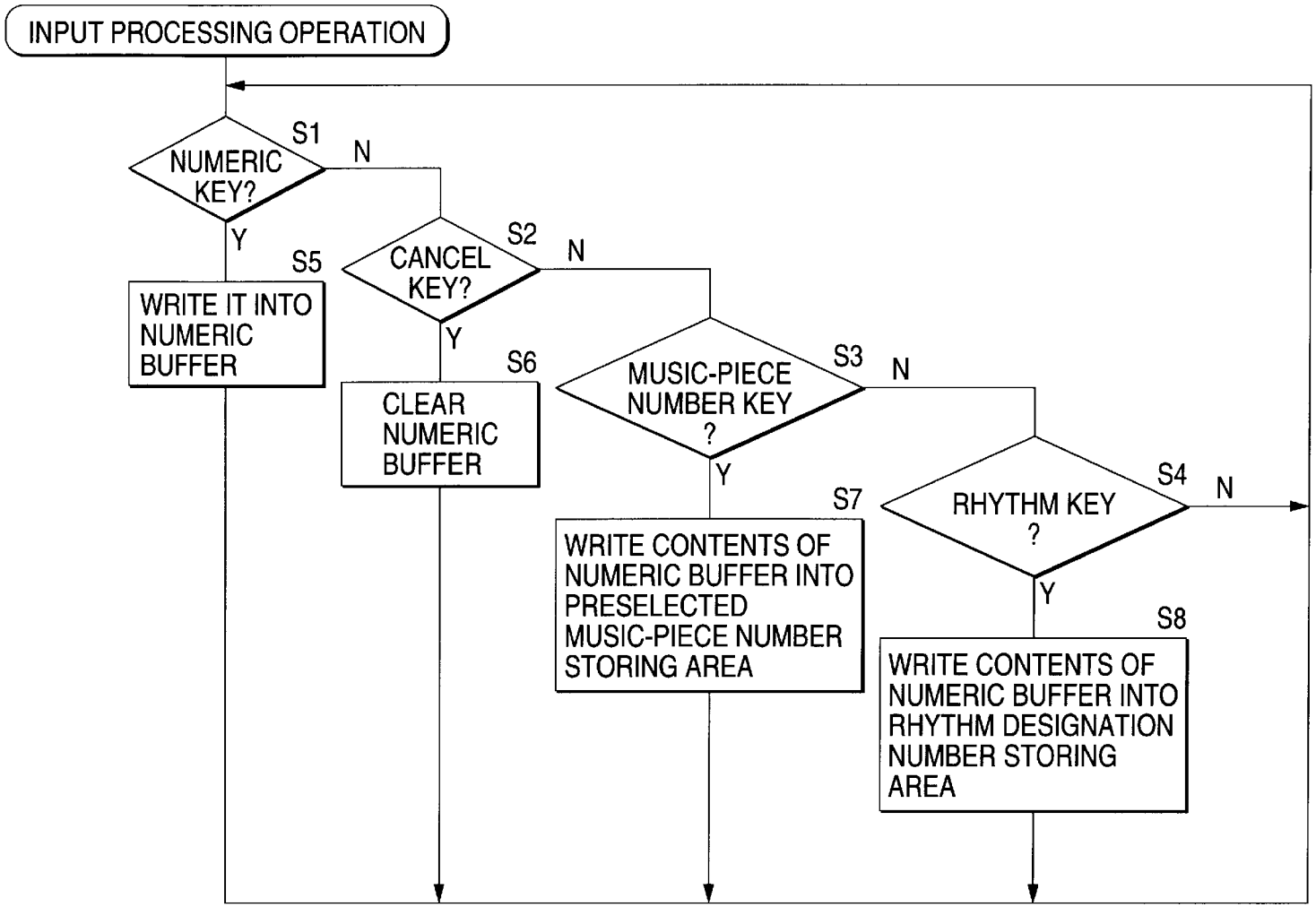
FIG. 6 is a flowchart showing a preselection processing operation in the karaoke apparatus.

FIG. 6 is a flowchart showing the preselection input processing operation. The operation is conducted in response to the input operation through the commander 50 or the panel switch 28. In steps S1 to S4, the operations of the key switch of the numeric keys 51, the cancel key 54, the music-piece number key 52, and the rhythm key 53 are monitored. The monitoring operation is executed at all times including a period when the karaoke performance is conducted. When the operation of the numeric keys 51 is detected (S1), the numeric value input by the operation of the keys is written into the numeric buffer 228 (S5). When the operation of the cancel key 54 is detected (S2), the contents of the numeric buffer 228 are cleared (S6). When the depression of the music-piece number key 52 is detected (S3), the contents of the numeric buffer 228 are written into the preselected music-piece number storing area 221 as the preselected music-piece number (S7). When the depression of the rhythm key 53 is detected (S4), the contents of the numeric buffer 228 are written into the rhythm designation number storing area 222 as the number for designating a rhythm (S8). The operation of writing the rhythm number is conducted so as to correspond to the music-piece number which is input immediately before. That is, in the case where, after a music-piece number is input, a rhythm number is not input and the next music-piece number is input, the former music-piece number (the karaoke music piece) is treated in such a manner that it has no rhythm designation.

Figure 7:
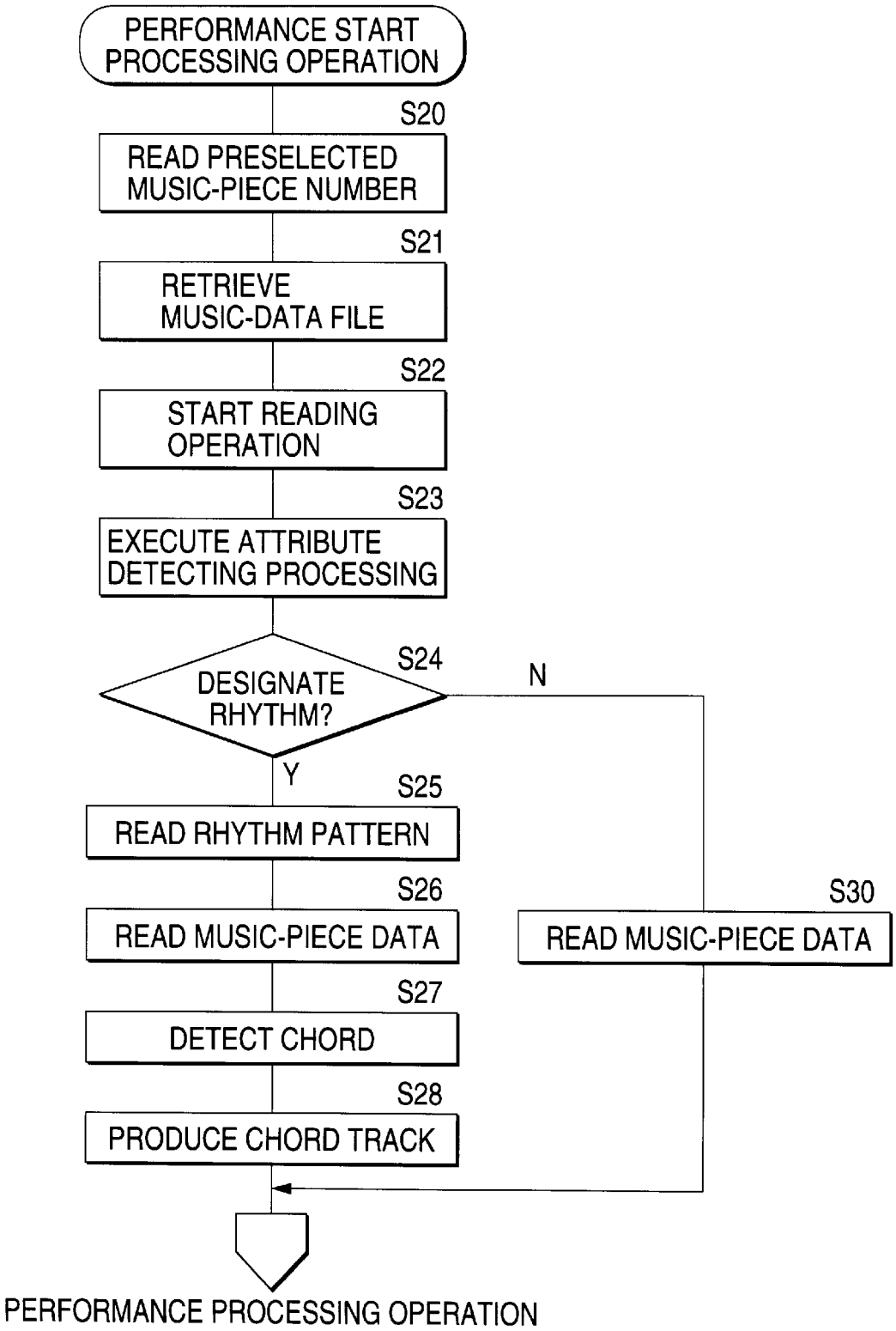
FIG. 7 is a flowchart showing a performance start operation.

FIG. 7 is a flowchart showing a performance start processing operation which is executed when a karaoke performance is started. Initially, the first one of the music-piece numbers is read from the preselected music-piece number storing area 221 (S20). A music-piece data for a music piece identified by the music-piece number is retrieved from the music-piece data file 241 (S21). The operation of reading the retrieved music-piece data to the preselected music-piece data reading area 223 of the RAM 22 is started (S22), and at the same time an attribute detecting processing is executed (S23). The attribute detecting processing operation is an operation for detecting an attribute of each track of the music-piece data.

Figure 8:
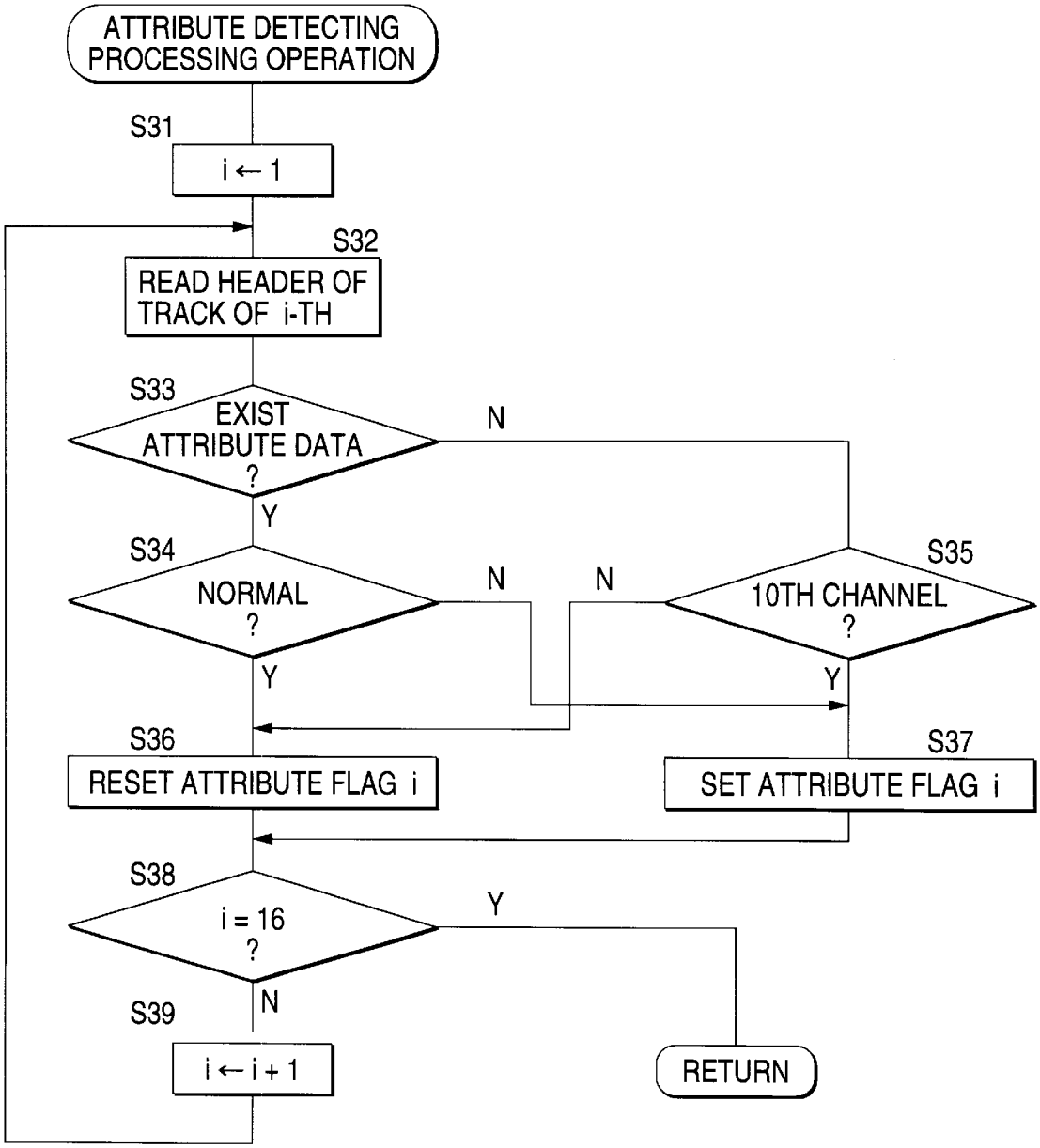
FIG. 8 is a flowchart showing an attribute detecting processing.

FIG. 8 shows a flowchart of the attribute detecting processing operation. First, a pointer i which indicates one of tracks 1 to 16 is set to be 1 (S31). The header of the track of the i-th channel is read (S32), and it is judged whether an attribute data of the track is written or not (S33). If the attribute data is written, it is judged whether the contents thereof indicate the normal attribute or a rhythm accompaniment attribute (S34). If the written data indicates the rhythm accompaniment attribute, the attribute flag corresponding to the track i is set to have a state corresponding to the drum attribute, the base attribute, or the chord accompaniment attribute (S37). By contrast, if the written data indicates the normal attribute, the attribute flag corresponding to the track i is reset (S36). If no attribute data is written, it is judged whether the track is a track corresponding to the 10th channel of the MIDI or not (S35). If the track corresponds to the 10th channel of the MIDI, the track is set in a default condition as a drum track, and hence the attribute flag is set to have a state corresponding to the drum attribute (S37). If the track corresponds to any other MIDI channel, the attribute flag is reset. The processing is executed for i=1 to 16 (S38 and S39), and the process then returns to the performance start processing operation.

In the performance start operation, when the attribute detecting processing operation (S23) is finished, the contents of the rhythm designation number storing area 222 are read, and it is judged whether a rhythm is designated for the music piece or not (S24). If any rhythm is not designated, the karaoke music piece is to be played as it is, and hence the music-piece data is directly read to the preselected music-piece data reading area 223 (S30). Thereafter, the process returns to the performance start operation.

By contrast, if a rhythm is designated, the rhythm pattern of the designated rhythm is read from the rhythm pattern file 242 and then stored into the designated rhythm pattern reading area 224 (S25). In parallel with the reading of the music-piece data to the preselected music-piece data reading area 223 (S26), a chord is detected based on the performance data of the melody system track (the track of the normal attribute) (S27). Then, a chord track 223*a* is produced based on the detected chord (S28). As described above, the chord track 223*a* stores a chord detected for every beat in time sequence, and consists of an event data indicating the detected chord and a delta time data indicating the interval of one beat.

Figure 9:
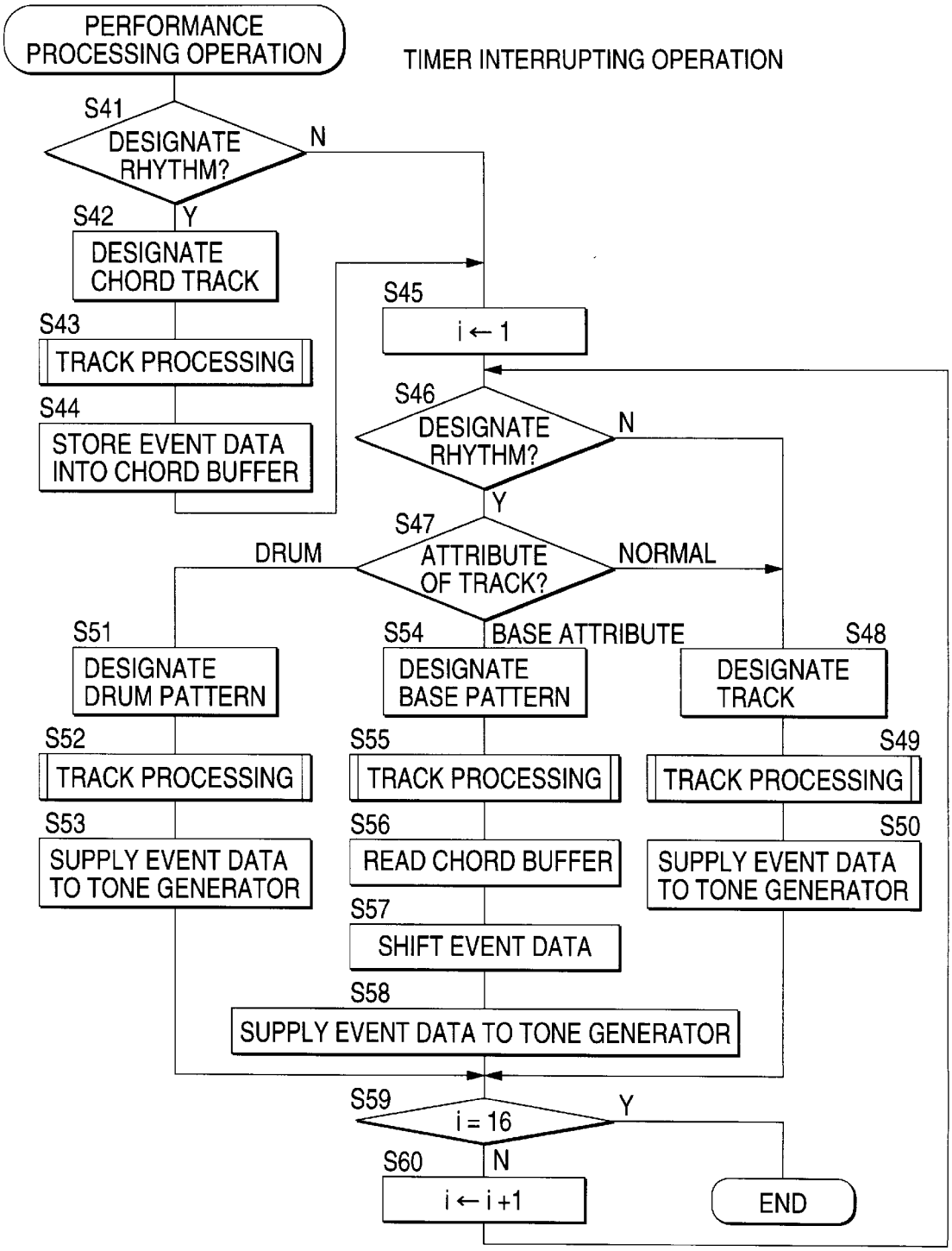
FIG. 9 is a flowchart showing a performance implementing operation.

FIG. 9 is a flowchart showing a performance processing operation. The operation is executed by a timer interrupting operation based on a tempo clock signal. First, it is judged whether a rhythm is designated or not (S41). If no rhythm is designated, the process directly proceeds to step S45. If a rhythm is designated, the produced chord track is first caused to progress. Accordingly, the chord track is first designated, and a track processing is executed (S43).

Figure 10:
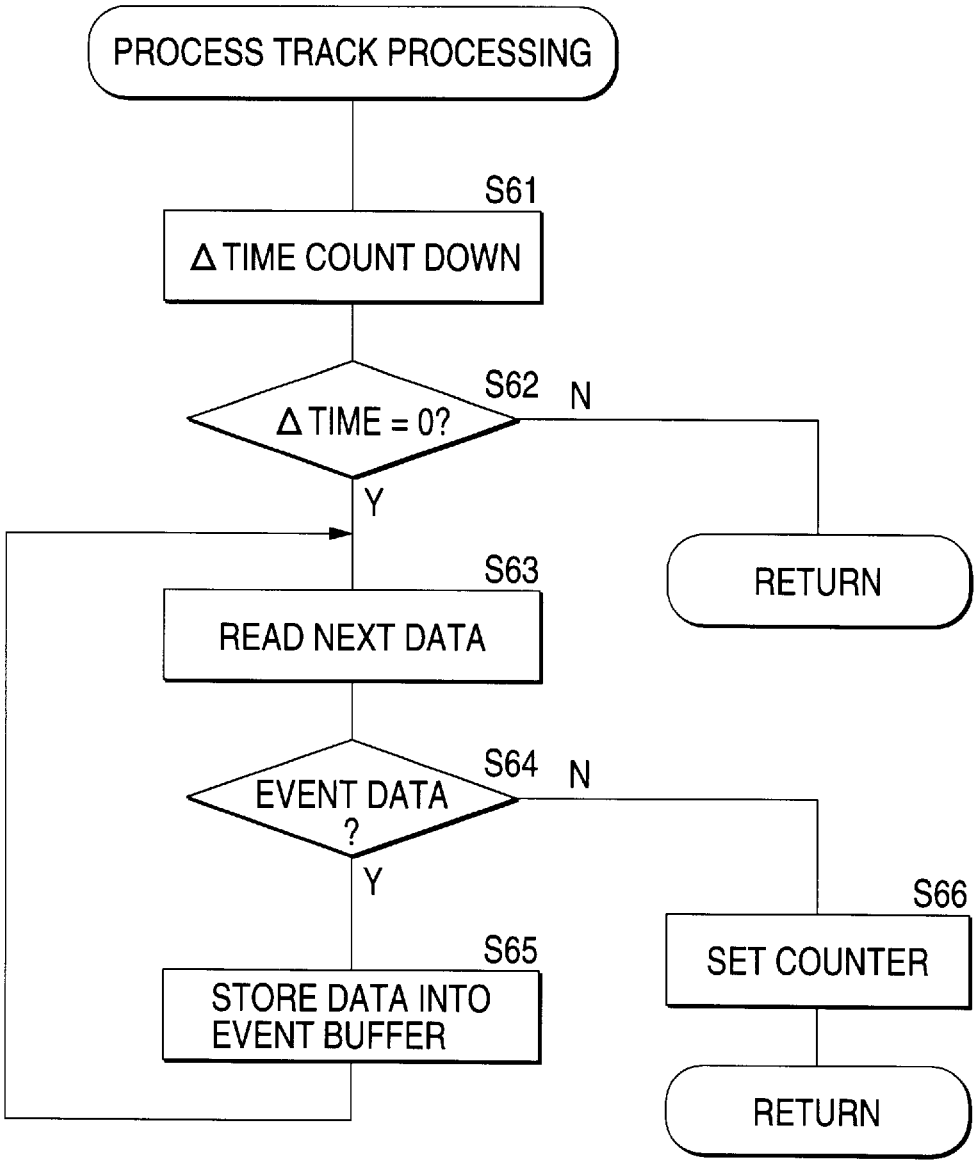
FIG. 10 is a flowchart showing a track processing operation.

FIG. 10 shows a track processing subroutine. First, a delta time counter of the corresponding track is counted down (S61). If the delta time does not become 0 as a result of the count down, the process returns to the performance processing operation. In this case, the event buffer has no contents. If the delta time counter becomes 0 as a result of the count down, the next data is read (S63). If the data is the event data (S64), the data is stored into the event buffer (S65), and the next data is again read (S63). If the read data is the delta time data, the contents thereof are set in the delta time counter (S66), and the process returns. In this case, the contents written in step S65 are stored into the event buffer.

Referring again to FIG. 9, if a data of any kind is written in the event buffer as a result of the track processing (S43), the data is transferred to the chord buffer (S44). The contents of the chord buffer indicate the chord of the karaoke music piece which is currently played. In step S45, 1 is set to the pointer i which designates the track (S45). Then, it is judged again whether the performance which is currently conducted is a performance with rhythm designation or not (S46). If the performance is to be conducted without rhythm designation, the process proceeds to the operation subsequent to step S48 irrespective of the attribute of the track. In step S48, the track i is designated, and the track processing is conducted on the track (S49). In the case where there exists an event data which has been read, the event data is supplied to the tone generator 29 (S50).

By contrast, if the performance is to be conducted with rhythm designation, the attribute of the track is judged (S47). If the track is a track of the normal attribute, the process proceeds to step S48. If the track is a track of the drum attribute, the process proceeds to step S51. In step S51, a drum pattern in the rhythm pattern which has been read to the designated rhythm pattern reading area 224 is designated (S51), and the track processing is conducted (S52). When an event data is read as a result of the track processing, the data is output to the tone generator 29 (S53). When the drum attribute is designated, a key chord, which indicates a tone pitch in the case of the normal attribute, functions to indicate the kind of the percussion.

If the attribute is the bass attribute or the chord accompaniment attribute, the bass pattern or the chord accompaniment pattern which has been read to the designated rhythm pattern reading area 224 is designated (S54), and the track processing is executed (S55). When an event data is read as a result of the track processing, the current chord is read from the chord buffer (S56). On the basis of the chord, the key chord data in the event data is shifted (S57). As a result, the rhythm pattern which is usually written in C Dur (C Major) can accord with the chord at that time. The shifted event data is supplied to the tone generator (S58).

The above-described operation is executed for each of the tracks i (=1 to 16) (S59 and S60), so that an automatic performance of the karaoke music piece is executed. When end marks are read in all of the tracks, the karaoke performance is terminated.

Although not shown in the flowcharts of the embodiment, the same processing is conducted for the display of the words.

In the above-described performance start processing operation, the chord is detected from the music-piece data read from the HDD 24. In the case where a chord track is previously included in the music-piece data, the chord track can be used and the detection of the chord is not required. The chord track which is previously included in the music-piece data is classified into the melody system attribute.

In the above-described embodiment, the rhythm designation is conducted at the same time with the preselection of a karaoke music piece. Alternatively, the rhythm may be changed by a rhythm designation input during (in the middle of) the performance of the karaoke music piece.

Figure 11:
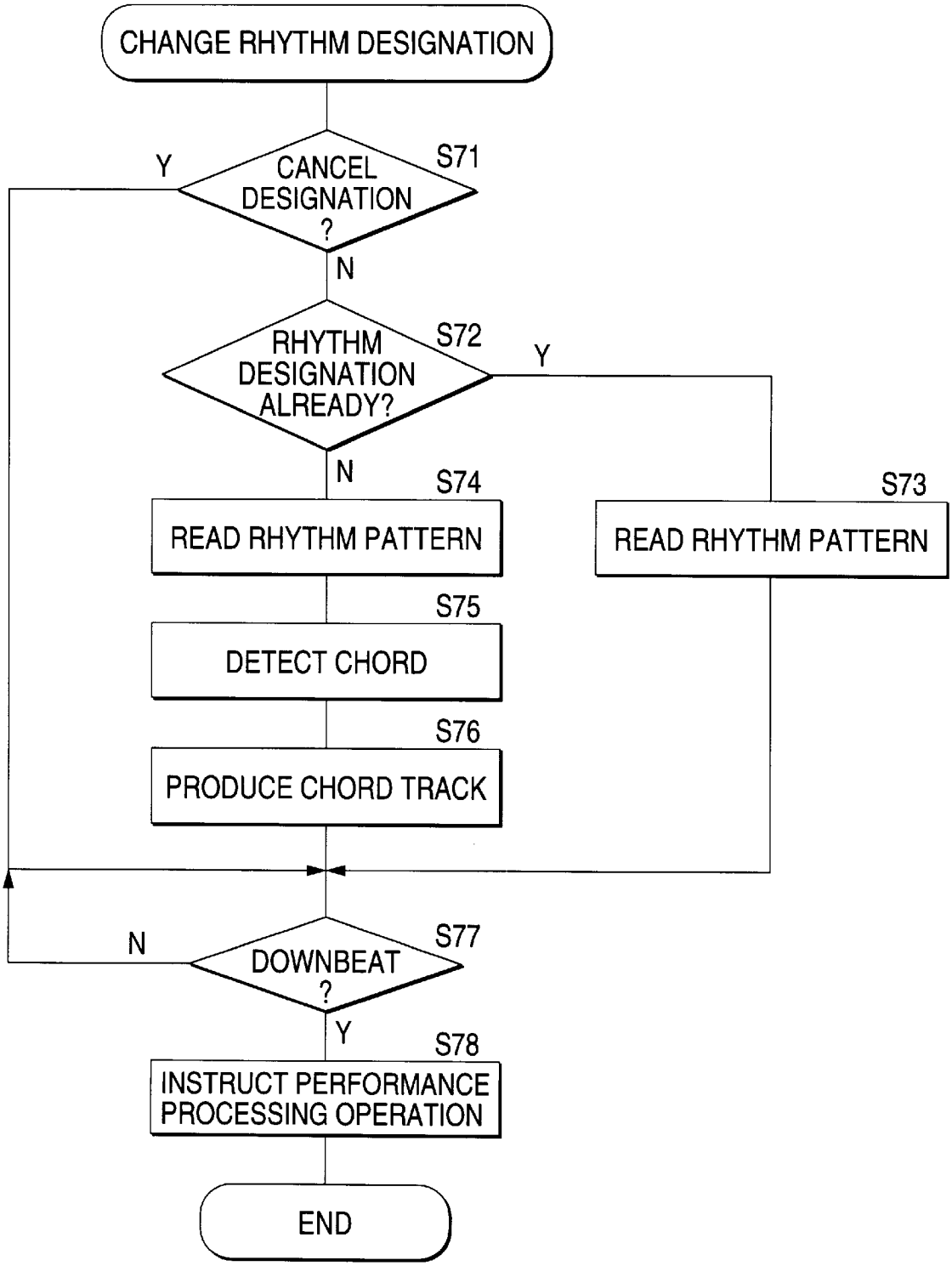
FIG. 11 is a flowchart showing a rhythm designation changing operation.

FIG. 11 shows the operation conducted when the rhythm is changed in the middle of the performance of a karaoke music piece. The operation is the processing which is executed in response to the input of the rhythm designation in the middle of the karaoke performance. First, it is judged whether the rhythm designation input indicates that the rhythm which has been designated is canceled and the rhythm is returned to the original rhythm of the music-piece data or not (S71). If yes, the process directly proceeds to step S77. In step S77, the process waits for a downbeat (the first beat or the third beat in the case of a quadruple time) of the karaoke performance which is currently played. When the karaoke performance is at the downbeat, the change of rhythm is instructed to the performance processing operation (FIG. 9) (S78). Thereafter, the process returns.

In the case where the rhythm designation input is an input for designating a new rhythm, the karaoke music piece has been played with the original rhythm of the karaoke music-piece data, and the rhythm designation is conducted for the first time, the rhythm pattern of the designated rhythm kind is read from the rhythm pattern file 242, and then stored into the designated rhythm pattern reading area 224 (S74). Then, a chord is detected based on the performance data of the melody system track of the music-piece data which has been read into the preselected music-piece data reading area 223 (S75). After a chord track 223*a* is produced based on the detected chord (S76), the process proceeds to step S77.

By contrast, in the case where the rhythm designation input is an input for designating a new rhythm, and the rhythm designation has been already conducted for the karaoke music piece which is currently played, the processing such as the chord detection has been already completed, and hence the designated rhythm pattern is read (S73). Then, the process proceeds to step S77.

As a result of the above-described operation, even in the case where the rhythm designation is changed in the middle of the performance of the karaoke music piece, the rhythm change can be started at the timing of a downbeat which is immediately after the designation input.

The part which is internally produced and replaced with the original one is not limited to the rhythm accompaniment system part, and may be a portion of parts of the percussion, base, and chord accompaniment.

As described above, according to the invention, a portion of parts such as a rhythm accompaniment part of an existing karaoke music piece can be changed from the original one to another one, so that a variation can be applied to a usual performance, and a part can be changed to a part which is preferred by the user. Therefore, the user's aspiration for singing a song is accordingly increased.

What is claimed is:

1. A karaoke apparatus comprising:

a reader for reading karaoke music-piece data including performance data for a plurality of parts;

a tone generator for generating musical tones of the plurality of parts by receiving the karaoke music-piece data from the reader;

performance data producing means for producing alternative performance data of a portion of the plurality of parts based on the read karaoke music-piece data; and supply means for supplying the alternative performance data of the portion of the plurality of parts produced by said performance data producing means to said tone generator, instead of the performance data of the corresponding portion of the plurality of parts in the read karaoke music-piece data.

2. A karaoke apparatus comprising:

a tone generator for generating scale system musical tones and nonscale system musical tones, a reader for reading karaoke music-piece data including scale system performance data for causing the tone generator to generate scale system musical tones of predetermined tone pitches and for reading nonscale system performance data for causing said tone generator to generate nonscale system musical tones of a rhythm accompaniment system, rhythm designating means for designating a rhythm;

performance data producing means for producing the nonscale system performance data of the rhythm designated by said rhythm designating means, based on the scale system performance data; and supply means for supplying the nonscale system performance data produced by said performance data producing means to said tone generator, instead of the nonscale system performance data of the read karaoke music-piece data.

3. A method for generating musical tones of a plurality of parts, comprising the steps of:

reading a karaoke music-piece data including performance data for the plurality of parts;

performance data producing means for producing alternative performance data of a portion of the plurality of parts based on the read music-piece data; and supplying the alternative performance data of the portion of the plurality of parts produced by said performance data producing means to a tone generator, instead of the performance data of the corresponding portion of the plurality parts in the read karaoke music-piece data.

4. A method for generating scale system music tones and nonscale system musical tones, comprising the steps of:

reading karaoke music-piece data including scale system performance data for causing a tone generator to generate scale system musical tones of predetermined tone pitches and reading nonscale system performance data for causing said tone generator to generate nonscale system musical tones of a rhythm accompaniment;

designating a rhythm;

producing the nonscale system performance data of the rhythm, based on the scale system performance data;

supplying the produced nonscale system performance data to said tone generator, instead of the nonscale system performance data of the read karaoke music-piece data.

* * * * *